US005244044A

United States Patent [19]

Henderson

[11] Patent Number: 5,244,044

[45] Date of Patent: Sep. 14, 1993

[54] CATCHER SUB

[75] Inventor: William D. Henderson, League City, Tex.

[73] Assignee: Otis Engineering Corporation, Dallas, Tex.

[21] Appl. No.: 895,000

[22] Filed: Jun. 8, 1992

[51] Int. Cl.[5] ..... E21B 34/10

[52] U.S. Cl. ..... 166/332; 166/238; 166/242

[58] Field of Search ..... 166/117.5, 118, 124, 166/153, 237, 238, 284, 332, 382, 387

[56] References Cited

U.S. PATENT DOCUMENTS

| | | | |
|---|---|---|---|
| 4,345,649 | 8/1982 | Baugh et al. | 166/387 X |
| 4,708,208 | 11/1987 | Halbardier | 166/387 |
| 4,828,037 | 5/1989 | Lindsey et al. | 166/238 |
| 4,862,966 | 9/1989 | Lindsey et al. | 166/153 X |
| 4,893,678 | 1/1990 | Stokley et al. | 166/374 |
| 5,020,600 | 6/1991 | Coronado | 166/387 |
| 5,044,444 | 9/1991 | Coronado | 166/387 |
| 5,069,280 | 12/1991 | McKee et al. | 166/124 X |
| 5,181,569 | 1/1993 | McCoy et al. | 166/332 |

OTHER PUBLICATIONS

Otis Engineering Corporation, *Products and Services* catalog, OEC 5516, p. 61 Copyrighted 1989 by Otis Engineering Corporation.

*Primary Examiner*—Ramon S. Britts
*Assistant Examiner*—Frank S. Tsay
*Attorney, Agent, or Firm*—Roland O. Cox

[57] ABSTRACT

An improved catcher sub has a longitudinal flow passage and a collet slidably mounted around the flow passage in the sub housing. The collet has a number of fingers and each finger has a resilient seal segment. The collet is held and supported in up fingers contracted position where the resilient seal segments seal on each other forming an annular seal ring smaller than the longitudinal flow passage. When high pressure is applied on a ball sealingly engaging the annular seal ring, the collet is supported in the up contracted position while the pressure moves an annular piston to a position which permits the collet to be moved to a lower expanded position larger than the longitudinal flow passage by a later application of lower pressure on the ball and the ball to be expended downwardly through the collet and sub flow passage.

8 Claims, 2 Drawing Sheets

CATCHER SUB

BACKGROUND OF THE INVENTION (1) Technical Field

This invention pertains to catcher subs connected in well flow conduits in which a ball seals to permit pressurization of fluid in the conduit above the ball. The invention especially pertains to a catcher sub from which the ball is expended only after pressure in the conduit is increased and later reduced.

(2) Background Information

A number of catcher subs are available for use in well conduits which permit pressurization of fluid in the conduit to operate pressure operated well tools in the conduit above the catcher sub. Very high fluid pressures, often in excess of 5,000 psi, are required to operate the pressure operated well tools and often pressures in excess of the very high operating well tool operating pressures are required to shear pins and expend a sealing ball and seat downwardly from the catcher sub. When pins are sheared by high well conduit pressures, a pressure shock wave is released to travel downwardly in the conduit from the catcher sub into open producing formations below, probably causing damage to the formations which will require expense and time to repair.

SUMMARY OF THE INVENTION

The improved catcher sub of this invention includes a collet slidably mounted in the catcher housing. The collet is moveable from an up contracted position to a down expanded position by applying pressure on a ball which seals on the collet when it is in contracted position. Pressure on the sealing ball high enough to operate pressure operated tools in the conduit above will not operate the catcher sub to expend the ball and produce a formation damaging pressure shock wave as the collet is held and supported in contracted position and not moved by ball down force from high pressure on the ball. The application of higher pressure operates the catcher sub to not hold and support the collet in up contracted position, permitting lower pressure applied thereafter to move the collet to expanded position. When the inside diameter of the expanding collet increases to that of the ball, downward flow will move the ball through the collet and expend it from the catcher sub.

DESCRIPTION OF THE PREFERRED EMBODIMENTS

Figure 1:
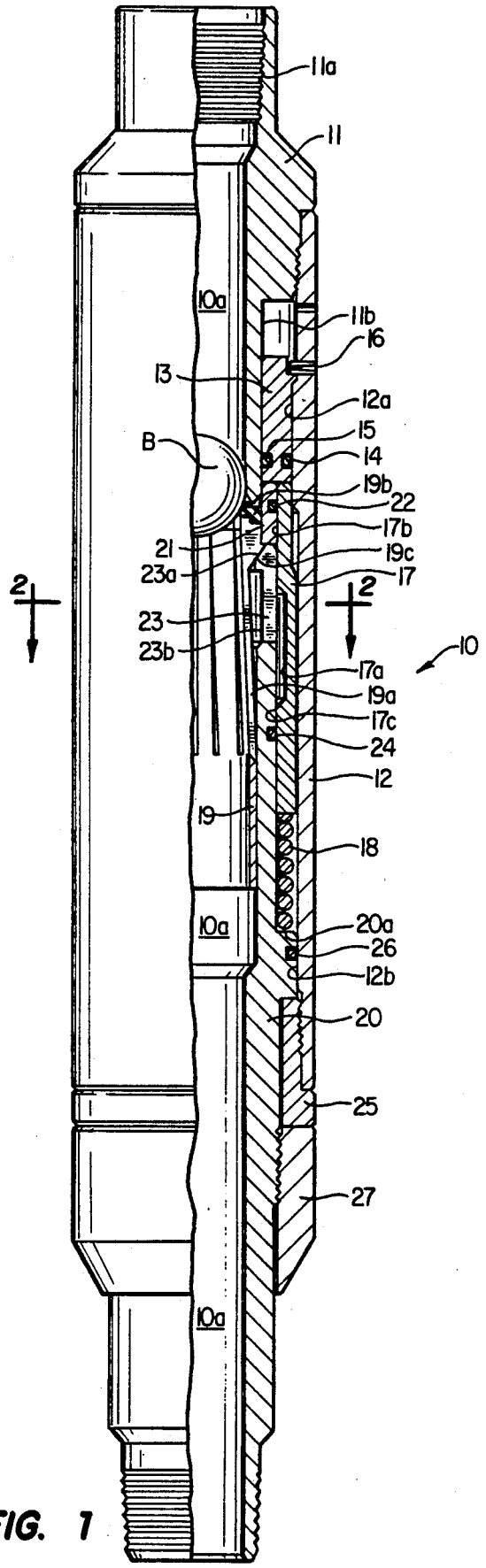
FIG. 1 is a half sectioned drawing in elevation showing one form of the improved catcher sub of this invention before operation to expend the ball.

The improved catcher sub 10 shown in FIG. 1 has a through flow passage 10*a* and includes a connector 11 having a thread 11*a* and a surface 11*b* sealingly engageable by seals. A housing 12 is connected to connection

Figure 2:
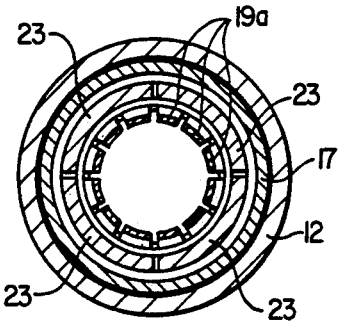
FIG. 2 is a drawing of the cross-section along line 2—2 in FIG. 1.

11 and in the housing are bores 12*a* and 12*b* each of which is sealingly engageable by seals. An annular piston 13 surrounds the lower portion of the connector. A resilient seal 14 on the piston sealingly engages seal bore 12*a* in the housing and a resilient seal 15 in the piston sealingly engages seal surface 11*b* on the connector and the piston is releasably positioned in the down position by shearable member 16. A longitudinally moveable sleeve 17 in the housing is biased to move upwardly by compressed spring 18 and has an internal groove 17*a* and bores 17*b* and 17*c*, which are sealingly engageable by seals. A longitudinally moveable collet 19 in mandrel 20 has fingers 19*a* (see also FIG. 2) and bonded on each finger is a resilient seal segment 19*b*. Each finger also has a camming surface 19*c*. A ring 21 around the collet holds the collet fingers in contracted position and seal segments 19*b* sealingly engaging each other to form an annular resilient seal ring. Another resilient seal 22 on the ring sealingly engages sleeve bore 17*b*. A number of lugs 23, each having a camming surface 23*a* and an underbore 23*b*, are held in contracted position by bore 17*b* in the sleeve, with surfaces 23*a* contacting camming surfaces 19*c* on each collet finger (see also FIG. 2).

A resilient seal 24 sealingly engages sleeve bore 17*c*, sealing the sleeve to mandrel 20. Spring 18 is compressed on mandrel shoulder 20*a* by sleeve 17, which is retained in the down position by piston 13, which is in turn releasably positioned by shearable member 16. An adapter ring 25 is connected to the lower end of housing 12 and a resilient seal 26 sealingly engages body bore 12*b* sealing the mandrel to the body. A guide ring 27 is connected on the mandrel below the adapter ring.

Figure 3:
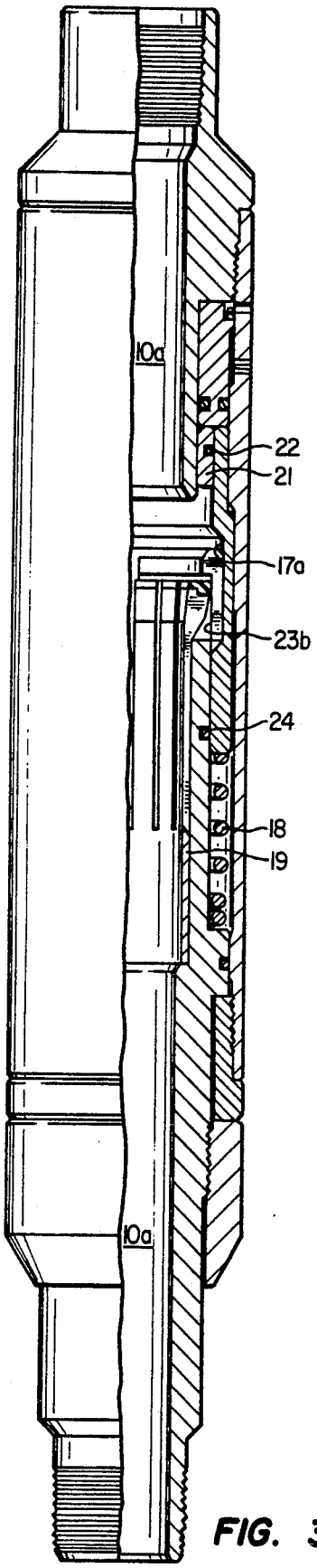
FIG. 3 is a drawing similar to FIG. 1 showing the improved catcher sub after operation to expend the ball.

In use, improved catcher sub 10 is installed in a well flow conduit below a tool such as a packer, which is operated by pressurizing the conduit. The well flow conduit is then lowered into the well. Before the conduit is pressurized, a ball B in the conduit above the catcher sub falls or is pumped downwardly to land and seal on the annular resilient seal ring formed by seal segments 19*b* on the contracted collet fingers closing the conduit for pressurization—see FIG. 1. Pressure, up into the 5,000 psi range, sufficient to operate the pressure operated tool may now be applied in the conduit and flow passage 10*a*. This pressure acts on piston seals 14 and 15 moving the piston upwardly shearing shearable members 16. Down force on the collet produced by pressure on the ball is transmitted through collet camming surface 19*c* and lug camming surface 23*a* to the lugs and into mandrel 20. After the pressure operated tool has operated, pressure in the conduit is reduced to about 150 psi, which reduces frictional forces between surfaces 19*c* and 23*a* and the lugs and sleeve bore 17*b*. Compressed spring 18 now exerts force sufficient to move sleeve 17 upwardly over seals 22 and 24. The sleeve is moved upwardly by the spring until sleeve groove 17*a* is adjacent the lugs. The down force of the sealed ball on the collet from low pressure in the conduit, will move the collet downwardly out of ring 21 and cam the lugs to expand into groove 17*a* and permit the collet fingers 19*a* to expand into overbores 23*b* in the lugs as shown in FIG. 3. Expansion of the collet disengages seal segments 19*b* and increases the inside diameter to greater than the outside diameter of ball B, permitting the ball to move downwardly in passage 10*a* and be expended out of the catcher sub.

Figure 4A:
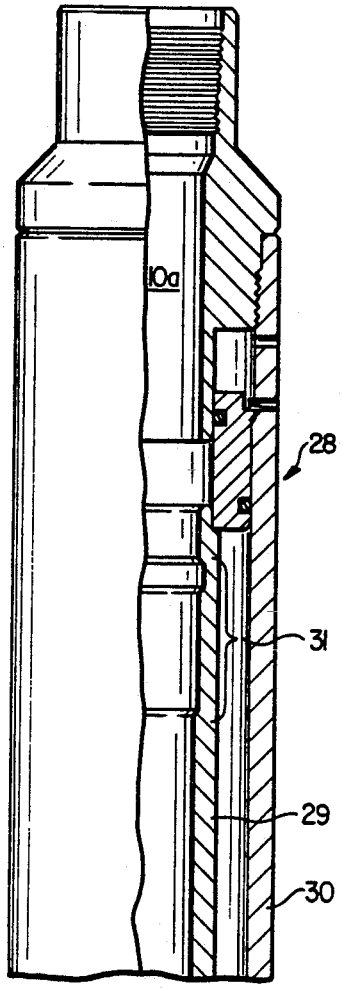
FIGS. 4A and 4B together are a half sectioned drawing in elevation of another form of the improved catcher sub, which includes an internal profiled recess and shows this catcher sub ready to receive an operating ball.
Figure 4B:
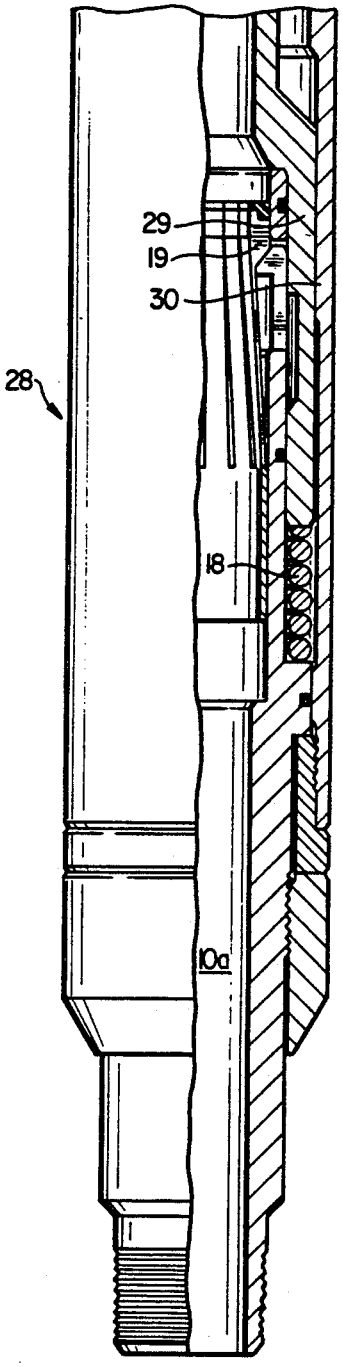

Another form of the improved catcher sub of this invention is depicted in FIGS. 4A and 4B. Improved catcher sub 28 is the same structure as improved catcher sub 10 and is operable in exactly the same way. The sleeve 29 and housing 30 in catcher sub 28 have been lengthened sufficiently to include profiled recesses 31.

If after a ball seals on contracted collet 19 in catcher sub 28, pressure in the conduit is increased and reduced and sleeve 29 is not moved upwardly by spring 18 preventing the collet from expanding, a tool can be lowered in the well conduit and operated to lock in recesses 31. Considerable upward force may then be applied to the tool locked in sleeve 29 to move the sleeve upwardly and allow the collet to expand and the ball be expended.

I claim:

1. An improved catcher sub comprising:

(a) a housing having a longitudinal flow passage therethrough;

(b) a collet slidably mounted in said housing;

(c) holding means in said housing for holding said collet in contracted position smaller than said flow passage;

(d) supporting means positioned by said holding means for supporting said collet in up contracted position against downward movement by a substantial downward force thereon, said holding means moveable by a predetermined pressure in said flow passage, permitting said collet to be moved thereafter by a small downward force thereon to a lower expanded position larger than said flow passage.

2. An improved catcher sub according to claim 1 wherein the collet has a number of fingers and each finger has a resilient seal segment thereon and said resilient segments sealingly engage each other when said collet is in contracted position to form an annular seal ring on the end of said collet.

3. An improved catcher sub according to claim 2 further including a ball sealingly engaging the annular seal ring so that when pressure is in the longitudinal flow passage said ball applies a downward force on the collet.

4. An improved catcher sub according to claim 2 wherein the holding means comprise:

(a) a ring for holding the collet contracted;

(b) an annular piston in the housing; and (c) a shearable member for releasably positioning said piston to position said ring around said collet.

5. An improved catcher sub according to claim 2 wherein each collet finger further includes a camming surface thereon and the supporting means comprise:

(a) a number of lugs around the collet, each lug having a camming surface engageable with said collet finger camming surfaces when said collet is held contracted;

(b) a sleeve around said lugs, said sleeve having an internal groove; and (c) biasing means for moving said sleeve upwardly.

6. An improved catcher sub comprising:

(a) a housing having a longitudinal flow passage therethrough;

(b) a collet slidably mounted in said housing, said collet having a number of fingers, each said finger having a resilient seal segment and a camming surface thereon;

(c) holding means in said housing for holding said collet in contracted position where said finger resilient seal segments sealingly engage each other and form an annular seal ring, said holding means comprising:

a ring for holding the collet contracted;

an annular piston in the housing; and a shearable member for releasably positioning said piston to position said ring around said collet;

(d) supporting means positioned by said holding means piston, said supporting means including:

a number of lugs around said collet, each lug having a camming surface engageable with s id collet finger camming surfaces when said collet is held contracted;

a sleeve around said lugs, said sleeve having an internal groove; and biasing means for moving said sleeve upwardly, said supporting means supporting said collet in up contracted position against downward movement by a substantial downward force thereon, said holding means sleeve moveable upwardly by said sleeve biasing means on application of a predetermined pressure in said flow passage releasing and moving said holding means annular piston to a position permitting said lugs to expand into said sleeve internal groove and permitting said collet to be moved downwardly thereafter to a lower position by a smaller downward force thereon where said collet fingers expand into said lug overbores.

7. The improved catcher sub of claim 6 further including a ball sealingly engaging the annular seal ring.

8. The improved catcher sub of claim 6 wherein the supporting means sleeve includes profiled recesses therein.

* * * * *